US008575838B2

(12) United States Patent
Raas et al.

(10) Patent No.: US 8,575,838 B2
(45) **Date of Patent: *Nov. 5, 2013**

(54) CERAMIC BURNER FOR CERAMIC METAL HALIDE LAMP

(75) Inventors: Marinus Cornelis Raas, Turnhout (BE); Franciscus Johannes Gerardus Hakkens, Eindhoven (NL); Durandus Kornelius Dijken, Eindhoven (NL); Adrianus Gerardus Maria De Nijs, Eindhoven (NL); Alexander Johannes Adrianus Cornelia Dorrestein, Eindhoven (NL); Josephus Christiaan Maria Hendricx, Eindhoven (NL); Peter Jozef Vrugt, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 261 days.

This patent is subject to a terminal disclaimer.

(21) Appl. No.: 12/519,178

(22) PCT Filed: Dec. 13, 2007

(86) PCT No.: PCT/IB2007/055079

§ 371 (c)(1), (2), (4) Date: Jun. 15, 2009

(87) PCT Pub. No.: WO2008/078228

PCT Pub. Date: Jul. 3, 2008

(65) Prior Publication Data

US 2010/0026183 A1 Feb. 4, 2010

(30) Foreign Application Priority Data

Dec. 20, 2006 (EP) ..... 06126720

(51) Int. Cl.

| | |
|---|---|
| ***H01J 5/48*** | (2006.01) |
| ***H01J 17/16*** | (2012.01) |
| ***H01J 61/30*** | (2006.01) |
| ***H01K 3/22*** | (2006.01) |

(52) U.S. Cl.
USPC ..... 313/634; 220/2.2; 313/318.01; 445/43

(58) Field of Classification Search
USPC ..... 220/2.2; 313/318.01, 634; 445/43
See application file for complete search history.

(56) References Cited

U.S. PATENT DOCUMENTS

| | | | | |
|---|---|---|---|---|
| 3,331,977 | A * | 7/1967 | Wainio | 313/34 |
| 5,637,960 | A | 6/1997 | Juengst et al. | |

(Continued)

FOREIGN PATENT DOCUMENTS

| | | | |
|---|---|---|---|
| EP | 0602529 | A2 | 6/1994 |
| EP | 0639853 | A1 | 2/1995 |
| JP | 63143738 | | 6/1988 |
| JP | 10284002 | | 10/1998 |

(Continued)

*Primary Examiner* — Karabi Guharay
*Assistant Examiner* — Michael Santonocito

(57) ABSTRACT

A ceramic burner, a ceramic metal halide lamp, and a method of sealing the ceramic burner is provided. The ceramic burner comprises a discharge vessel enclosing a discharge space that is provided with an ionizable filling comprising one or more halides. The discharge vessel comprises a ceramic wall arranged between a first and a second end portion. The first and the second end portion are arranged such that current supply conductors are passed through the end portions to respective electrodes arranged in the discharge space for maintaining a discharge. The ceramic wall of the discharge vessel comprises a tube for introducing the ionizable filling into the discharge vessel during manufacture of the ceramic burner. The tube projects from the ceramic wall and is provided with a gastight seal. The effect of using the tube is that it enables the gastight seal to be arranged away from the ceramic wall of the discharge vessel at a projecting end of the tube.

11 Claims, 3 Drawing Sheets

(56) References Cited

U.S. PATENT DOCUMENTS

| | | | | |
|---|---|---|---|---|
| 2004/0124776 | A1* | 7/2004 | Iorio et al. | 313/625 |
| 2005/0179388 | A1* | 8/2005 | Strok | 313/634 |
| 2006/0001346 | A1 | 1/2006 | Vartuli et al. | |

FOREIGN PATENT DOCUMENTS

| | | | |
|---|---|---|---|
| WO | 9307638 | A1 | 4/1993 |
| WO | 9418693 | A1 | 8/1994 |
| WO | WO 2005124823 | A1 * | 12/2005 |

* cited by examiner

CERAMIC BURNER FOR CERAMIC METAL HALIDE LAMP

FIELD OF THE INVENTION

The invention relates to a ceramic burner for a ceramic metal halide lamp.

The invention also relates to a ceramic metal halide lamp and to a method of sealing the ceramic burner.

BACKGROUND OF THE INVENTION

Ceramic metal halide lamps contain fillings which comprise besides a starter gas also metal halide salt mixtures such as NaCe iodide, NaTl iodide, NaSc iodide, NaTlDy iodide, or combinations of these salts. These metal halide salt mixtures are applied to obtain, inter alia, a high luminous efficacy, a specific color-corrected temperature, and a specific color rendering index.

Generally, such ceramic metal halide lamps comprise a discharge vessel enclosing a discharge space comprising the filling of the metal halide salt mixtures. The discharge space further comprises electrodes between which a discharge is maintained. Typically, the electrodes pierce through the discharge vessel. To fill the ceramic metal halide lamp with the metal halide salt mixture, a filling-opening is typically provided which is subsequently closed with a closing-plug.

An embodiment of such a ceramic metal halide lamp is known from the Japanese patent application JP 10284002. In the known discharge lamp, the lamp consists of an airtight container having a plug made of a material having almost the same coefficient of thermal expansion for aligning a pair of electrodes. The container further comprises an exhaust opening. The discharge medium is introduced into the container through the exhaust opening, which is then closed by means of a T-shaped plug that fits the opening in the container. The T-shaped plug is fused to the wall of the container through irradiation with a laser that is aimed at the T-shaped plug. A disadvantage of the known ceramic metal halide lamp is that, when the container is miniaturized, the T-shaped plug cannot be closed without increasing the temperature of the entire burner, heating up the filling.

SUMMARY OF THE INVENTION

It is an object of the invention to provide a ceramic burner for a ceramic metal halide lamp with a sealed exhaust opening which can be closed without heating up the filling.

According to a first aspect of the invention, the object is achieved with a ceramic burner for a ceramic metal halide lamp, which ceramic burner comprises a discharge vessel enclosing a discharge space in a substantially gastight manner and is provided with an ionizable filling comprising one or more halides, the discharge vessel comprising a ceramic wall arranged between a first and a second end portion, the first and the second end portion being arranged such that current supply conductors are passed through the end portions to respective electrodes arranged in the discharge space for maintaining a discharge, the ceramic wall of the discharge vessel comprising a tube for introducing the ionizable filling into the discharge vessel during manufacture of the ceramic burner, which tube projects from the ceramic wall and is provided with a gastight seal.

The effect of the measures according to the invention is that the use of the tube enables the gastight seal to be arranged away from the ceramic wall of the discharge vessel at a projecting end of the tube. Due to this distance between the gastight seal and the ceramic wall, the tube can be sealed without damaging the ceramic wall of the discharge vessel. In the known container, the exhaust opening is applied directly in the wall of the container. Sealing of the exhaust opening is done by filling the exhaust opening with a T-shaped plug and subsequently fusing the T-shaped plug to the wall of the container through irradiation by a laser. The laser irradiation locally increases the temperature of the T-shaped plug and the container to the melting temperature of the ceramic material, which is around 2100° C. This local increase of the temperature creates a considerable local temperature gradient which may result in cracks in the ceramic material of the container. To reduce the occurrence of cracks, part of the known container is heated to approximately 800° C. for reducing the temperature gradient near the sintering location of the T-shaped plug while the known container is being sealed. However, a further portion of the container must be at a temperature below 350° C. to ensure that the ionizable filling of the container does not evaporate and is not blown out of the container via the exhaust opening before the container is sealed. To overcome this problem, the further portion of the container is cooled. In the ceramic burner according to the invention, however, the discharge vessel comprises the tube that projects from the ceramic wall. After the discharge vessel has been filled with the ionizable filling through the tube, the projecting end of the tube must be sealed. The projecting end of the tube extends sufficiently far from the ceramic wall such that it can be sealed while the temperature of the ceramic wall and thus of the discharge vessel does not exceed a predefined temperature limit, which prevents the ionizable filling from evaporating. Furthermore, the limited temperature increase of the ceramic wall prevents cracks in the ceramic wall due to material stress and tension which would result from a large temperature gradient. The use of the tube projecting from the ceramic wall enables the discharge vessel of the ceramic burner to be reduced in size, because the projecting end of the tube can be sealed while the local preheating of the ceramic wall and the cooling of another portion of the discharge vessel are omitted.

The inventors have realized that when miniaturizing the discharge vessel, the sealing of the known container via local heating of the container is no longer feasible without increasing the temperature of the entire container. In the ceramic burner according to the invention, the use of the tube enables a gastight seal at the projecting end of the tube without increasing the temperature of the discharge vessel above a predetermined level.

A further benefit of the fastening of the tube to the ceramic wall of the discharge vessel is that the gastight seal can be provided at the projecting end of the tube relatively quickly, resulting in a processing time which is economically interesting. In the known container, one part of the container must be heated to approximately 800° C. before the laser can be applied for fitting the T-shaped plug to the container. Furthermore, this must be done for each container, requiring a heating ring applied to the part of the container which must be heated, all of which takes a considerable operating and heating time. In the ceramic burner according to the invention, the additional local heating of the discharge vessel can be omitted because of the tube projecting from the ceramic wall. Only the projecting end of the tube must be heated for applying the gastight seal, which typically requires less time. As a result, the operating time for sealing the ceramic burner after the ionizable filling has been fed into the discharge vessel is considerably reduced according to the invention.

As used herein, "ceramic" means a refractory material such as a mono-crystalline metal oxide (e.g. sapphire), polycrystalline metal oxide (e.g. polycrystalline densely sintered aluminum oxide and yttrium oxide), and polycrystalline non-oxidic material (e.g. aluminum nitride). Such materials allow wall temperatures of 1500 to 1700 K and resist chemical attacks by halides and other filling components. For the purpose of the present invention, polycrystalline aluminum oxide (PCA) was found to be most suitable.

The use of a tube as a current supply conductor at the first and second end-portion for filling the ceramic discharge vessel is disclosed in the international patent application WO 93/07638. However, a drawback of the use of the tube as a current supply conductor is that the tube is arranged at a relatively low-temperature part of the discharge vessel, which typically results in a color-instable discharge lamp owing to condensation of compounds from the ionizable filling of the discharge lamp in the tube. In the ceramic burner according to the invention, the tube is arranged at the ceramic wall of the discharge vessel. As a consequence, the temperature inside the tube remains relatively high during operation, which prevents compounds of the ionizable filling from condensing in the tube, so that a substantially color-stable discharge lamp is obtained.

In an embodiment of the ceramic burner, the tube projects over a predefined distance from the ceramic wall of the discharge vessel for the purpose of limiting material stress to below a predefined level when the gastight seal is provided. The predefined level, for example, represents a level of material stress at which no cracks appear in the ceramic material. Having a material stress above the predefined level typically results in cracks in the ceramic material, which substantially limits the lifetime of the discharge vessel or results in a discharge vessel not being gastight. The optimum projecting distance of the tube for which the material stress remains below the predefined level may be different for different ceramic materials of the discharge vessel.

In an embodiment of the ceramic burner, the predefined distance is at least 1 mm from the ceramic wall. Without being obliged to give any theoretical explanation, the inventors have found that a tube projecting at least 1 mm from the ceramic wall can be sealed, for example, through irradiation of the projecting end of the tube with a laser beam, while substantially avoiding cracks in the ceramic wall of the discharge vessel.

In an embodiment of the ceramic burner, the tube pierces through the ceramic wall. Since the tube is passed through the ceramic wall, the tube will not only project from the discharge vessel for limiting the material stress when the gastight seal is being applied, but it will also enter the discharge vessel through the ceramic wall, which renders a strong and gastight connection between the ceramic wall and the tube possible.

In an embodiment of the ceramic burner, the tube comprises substantially the same ceramic material as the ceramic wall. A benefit of this embodiment is that the use of the same ceramic material results in relatively low compression and/or tensile stresses between the ceramic wall and the tube during operation of the ceramic burner in the ceramic metal halide lamp and during the increase in temperature when the gastight seal is being made.

In an embodiment of the ceramic burner, the gastight seal is constituted of molten material of the tube. A benefit of this embodiment is that the gastight seal is produced by melting the projecting end of the tube, which results in a relatively simple sealing process. No additional materials such as frit are necessary, which materials may contaminate the discharge vessel or may react with the ionizable filling of the ceramic burner, thus altering the color of the emitted light. Furthermore, no plugs are required, which simplifies the handling of the discharge vessel, because no plug must be placed on the projecting end of the tube. Providing the plug at the projecting end of the tube requires special, relatively expensive handling equipment, especially when miniaturizing the discharge vessel.

In an embodiment of the ceramic burner, the tube has an inner diameter of between 250 μm and 400 μm and has a wall thickness of between 150 μm and 250 μm. The inner diameter of the tube is at least 250 μm to ensure that the ionizable filling of the ceramic burner can be introduced into the discharge vessel. The inner diameter should preferably not exceed 400 μm because this would require too much tube material to be molten for creating a gastight seal, resulting in a relatively high thermal strain when the gastight seal is being provided, possibly damaging the tube. Furthermore, the wall thickness of the tube should be at least 150 μm to ensure that the tube is strong enough to withstand the thermal gradient caused by the creation of the gastight seal and to allow enough ceramic wall material to be molten to close the projecting end of the tube. The wall thickness of the tube should not exceed 250 μm because melting the tube for creating the gastight seal would take a relatively long time, which also results in a relatively high thermal strain which might damage the tube when the gastight seal is being made. Preferably, the wall thickness should be substantially half the diameter of the tube.

In an embodiment of the ceramic burner, the gastight seal comprises a plug sealed to the tube. A benefit of this embodiment is that the use of a plug considerably reduces an area which must be sealed to generate the gastight seal. When a plug is applied in the projecting end of the tube, only the contact area between the plug and the tube must be sealed. This typically requires less time, and less sealing material need be used.

In an embodiment of the ceramic burner, the plug has a T-shape, or a conical shape, or a substantially spherical shape. A benefit of a T-shaped plug is that when being provided the plug cannot drop into the discharge vessel. A benefit of a conical shape is that tolerances on the dimensions of the projecting end of the tube may be relaxed. A benefit of a substantially spherical shape is that the spherically shaped plug can be easily picked up and placed on the projecting end of the tube by a placement tool, for example by vacuum.

In an embodiment of the ceramic burner, the plug is directly fused to the tube. A benefit of this embodiment is that fusing of the plug to the tube avoids the use of a sealing frit material. Typically, a seal constituted of a frit may degrade due to the chemically harsh environment inside the discharge vessel and due to the high temperature at the ceramic wall of the ceramic burner. This degradation typically results in leakage of the seal over time, which limits the life-time of the ceramic burner. Furthermore, the temperature is typically lower in the cracks or crevices, allowing part of the ionizable filling to condense and effectively be removed from the discharge, changing the color appearance of the ceramic burner. The projecting tube enables the plug to be directly fused to the projecting end of the tube, for example through irradiation with a laser beam, while a rise in temperature of the remainder of the discharge vessel is limited, so that the ionizable filling will not flow out of the discharge vessel before the discharge vessel has been sealed, while major temperature gradients in the ceramic wall which may lead to cracks and damage to the discharge vessel are avoided.

In an embodiment of the ceramic burner, a location of the tube at the ceramic wall is chosen so as to prevent the temperature inside the tube, in operation, to be less than a condensation temperature of substantially any component of the ionizable filling. A benefit of this embodiment is that when the temperature inside the tube, during operation, remains high enough, no components from the ionizable filling will condense and as such be removed from the discharge, which results in the ceramic burner being substantially stable in color. Especially in dimmable ceramic burners, the temperature distribution at the ceramic wall may change during dimming. During dimming of the ceramic burner the temperature of the ceramic wall of the discharge vessel is typically reduced relative to the non-dimmed state, resulting in a change of the temperature in the tube. The location of the tube at the ceramic wall must be chosen such, especially for a dimmable ceramic burner, that also during dimming the temperature inside the tube is not less than the condensation temperature of any component of the ionizable filling, resulting in a dimmable ceramic burner which remains substantially stable in color during dimming.

In an embodiment of the ceramic burner, the current supply conductors through each of the first and the second end portions are formed by solid rods directly sintered into the ceramic material of the first and second end portion. A benefit of this embodiment is that this arrangement of the current supply conductors renders possible a miniaturized discharge vessel which comprises no frit. In known burners, the current supply conductors are typically mounted by means of extended plugs which are sealed with a frit. The extended plugs are necessary to avoid that the temperature of the frit exceeds a predefined temperature, which typically is substantially below the operating temperature of the discharge in the discharge vessel. A drawback of this known use of the frit for sealing the discharge vessel around the current supply conductors is that the extended plugs prevent miniaturization of the discharge vessel and of the ceramic burner. Furthermore, sealing of the discharge vessel using a frit typically causes crevices to be present at relatively low temperatures, in which crevices compounds of the ionizable filling may condense, resulting in a change of the color of the discharge lamp during operation. No crevices are present if the current supply conductors are directly sintered according to the invention, resulting in a substantially color-stable ceramic burner.

The invention also relates to a ceramic metal halide lamp. The invention further relates to a method of sealing the ceramic burner according to the invention, which method comprises a step of creating the gastight seal through irradiation with a laser beam.

BRIEF DESCRIPTION OF THE DRAWINGS

These and other aspects of the invention are apparent from and will be elucidated with reference to the embodiments described hereinafter.

In the drawings.

The Figures are purely diagrammatic and not drawn to scale. Some dimensions have been exaggerated particularly strongly for greater clarity. Similar components in the Figures are denoted by the same reference numerals as much as possible.

DETAILED DESCRIPTION OF EMBODIMENTS

Figure 1A:
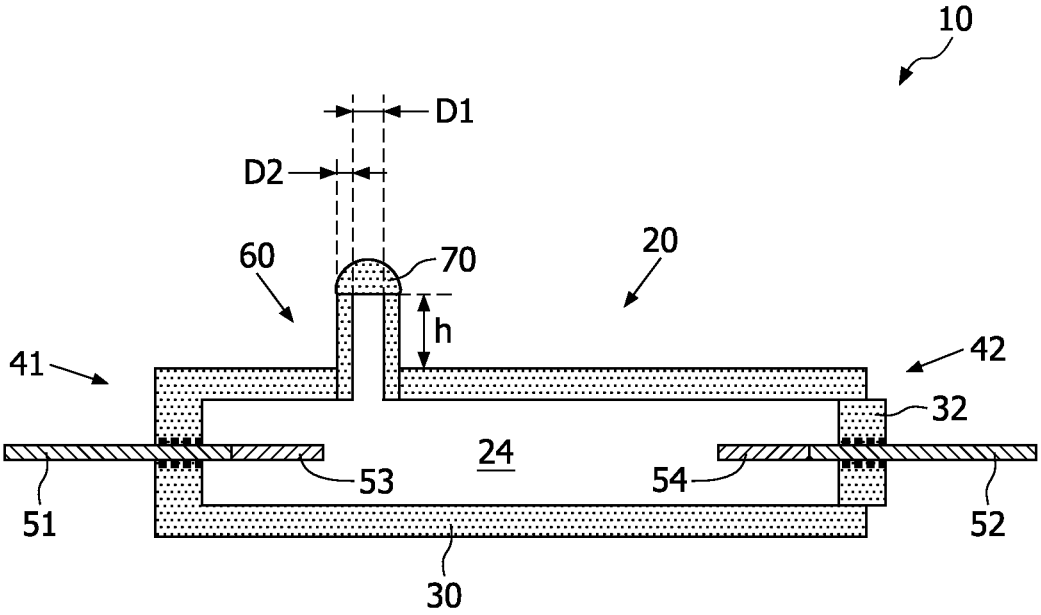
FIGS. 1A, 1B and 1C are cross-sectional views of embodiments of a ceramic burner according to the invention having a cylindrical discharge vessel.
Figure 1B:
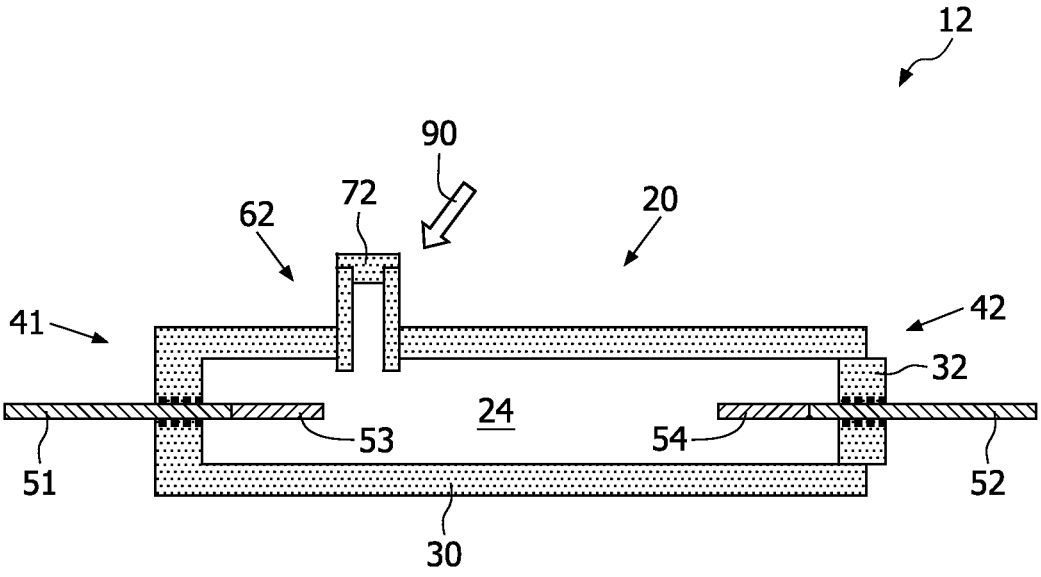
Figure 1C:
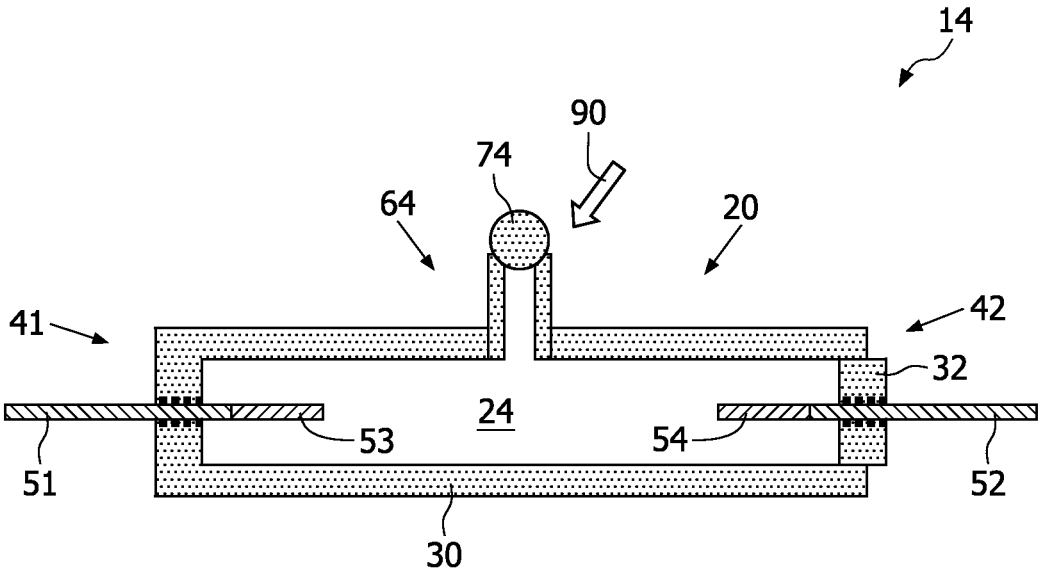

FIGS. 1A, 1B and 1C are cross-sectional views of embodiments of a ceramic burner 10, 12, 14 according to the invention having a cylindrical discharge vessel 20. The ceramic burner 10, 12, 14 comprises a discharge vessel 20 enclosing a discharge space 24. The discharge vessel 20 is substantially formed from a ceramic material, such as aluminum oxide ($Al_2O_3$). The discharge vessel 20 comprises a first and a second end portion 41, 42 where the current supply conductors 51, 52 are passed through the discharge vessel 20. The current supply conductors 51, 52 are preferably formed by rods 51, 52 directly sintered into the ceramic material of the discharge vessel 20. Generally, an electrode 53, 54 is connected to the current supply conductors 51, 52 at a side of the current supply conductors 51, 52 facing the discharge space 24. The electrode 53, 54 is often made from tungsten. The current supply conductors 51, 52 are connected to the electrodes 53, 54 for supplying power to the electrodes for initiating and maintaining a discharge in the discharge space 24. The ceramic burner 10, 12, 14 comprises a tube 60, 62, 64 projecting from the ceramic wall 30 away from the discharge wall 30. The tube 60, 62, 64 is arranged for introducing the ionizable filling into the discharge vessel 20 during manufacture of the ceramic burner 10, 12, 14. The tube 60, 62, 64 is closed off with a gastight seal 70, 72, 74.

The effect of using the tube 60, 62, 64 is that it enables the gastight seal to be arranged away from the ceramic wall 30 of the discharge vessel 20 at a projecting end of the tube 60, 62, 64. A benefit of this arrangement is that only the projecting end of the tube 60, 62, 64 must be heated when the gastight seal 70, 72, 74 is being provided. The gastight seal 70, 72, 74 is, for example, formed from molten material 70 of the tube 60, 62, 64 itself or, for example, is formed by a plug 72, 74 of material positioned in the projecting end of the tube 60, 62, 64. The projecting end of the tube 60, 62, 64 must be heated for creating the gastight seal 70, 72, 74.

In the embodiment of the ceramic burner 10 shown in FIG. 1A, part of the material of the projecting tube 60 is melted. In the embodiment of the ceramic burner 12, 14 shown in FIGS. 1B and 1C, the projecting end of the tube 62, 64 comprises a plug 72, 74 which is fused to the projecting end of the tube 62, 64 by heating of the plug 72, 74 and/or the projecting tube 62, 64 at an interface between the plug 72, 74 and the projecting end of the tube 62, 64. Due to a predefined distance h prevailing between the gastight seal 70, 72, 74 and the ceramic wall 30, the tube 60, 62, 64 can be sealed while a temperature increase of the remainder of the discharge vessel 20 is limited. Limiting the temperature increase of the discharge vessel 20 when the gastight seal 70, 72, 74 is being applied results in a relatively small temperature gradient across the discharge vessel 20, which typically prevents cracks in the ceramic material of the discharge vessel 20. Furthermore, the temperature of the discharge vessel 20 comprising the ionizable filling should not exceed a predefined temperature before the discharge vessel 20 is made gastight. This is to prevent part of the ionisable filling from flowing out of the discharge vessel 20, which would result in a concentration of the ionizable filling which is less than required for good operation of the ceramic burner 10, 12, 14. A further benefit of the tube 60, 62, 64 is that the local heating of the projecting end of the tube 60, 62, 64 for generating the gastight seal 70, 72, 74 is achieved relatively quickly, which reduces the processing time for sealing the discharge vessel 20 considerably and thus results in an economically interesting sealing method.

The tube 60, 62, 64 projects from the burner by the predefined distance h. The optimum projection distance h of the tube 60, 62, 64 may be different for different ceramic materials used for the ceramic wall 30 and/or used for the tube 60, 62, 64. The inventors have found that a tube 60, 62, 64 projecting by at least 1 mm from the ceramic wall 30 can be sealed, for example, through irradiation of the projecting end of the tube 60, 62, 64 with a laser beam (indicated with an arrow 90 in FIGS. 1B and 1C) while cracks in the ceramic wall 30 of the discharge vessel 20 are substantially avoided.

In the embodiment shown in FIG. 1A, the tube 60 is a separate tube 60 arranged in the ceramic wall 30 of the discharge vessel 20. The tube 60 projects from the ceramic wall 30 by the predetermined distance h. In the embodiment shown in FIG. 1A, the projecting end of the tube 60 is sealed by melting of the projecting end of the tube 60. The embodiment shown in FIG. 1A further comprises a further plug 32 arranged at an end portion 42 of the discharge vessel 20. The further plug 32 comprises, for example, the current supply conductor 52 directly sintered to the further plug 32. In the embodiment shown in FIG. 1A, the further plug 32 is made from the same ceramic material as the ceramic wall 30. The use of the further plug 32 renders it possible to generate a seal (indicated with a bold dotted line at the interface between the further plug 32 and the current supply conductor 52) between the further plug 32 and the current supply conductor 52 by a process different from the process for manufacturing the ceramic wall 30. This alternative production process of the further plug 32 may, for example, generate a relatively strong bond between the further plug 32 and the current supply conductor, while the further plug 32 may be impermeable to the light emitted from the discharge space 24 of the ceramic burner 10, for example through the use of a specific sintering process. The further plug 32 thus enables the current supply conductors to be sealed with a relatively strong bond while the ceramic wall 30 of the ceramic burner 10 remains substantially transparent to the light emitted from the discharge space 24. Alternatively, the current supply conductor 51 may be directly sintered to the discharge vessel 20 (indicated with a bold dotted line at the interface between the discharge vessel 20 and the current supply conductor 51), for example as shown at the other end portion 41 of the ceramic burner 10 of FIG. 1A.

In the embodiment shown in FIG. 1B, the tube 62 pierces though the ceramic wall 30 of the discharge vessel 20. Since it passes right through the ceramic wall 30, the tube 62 will not only project from the discharge vessel 20, but will also penetrate the discharge vessel 20 beyond the ceramic wall 30. This leads to a strong and gastight connection between the ceramic wall 30 and the tube 62. The tube 62 is formed from the same material as the ceramic wall 30, which results in relatively low mechanical stresses, for example in the case of a temperature gradient when the gastight seal 72 is being created or when the ceramic burner 12 is operating. The projecting end portion of the tube 62 shown in the embodiment of FIG. 1B further comprises a plug 72 for providing the gastight seal 72 and sealing the discharge vessel 20. The plug 72 is fused to the projecting end of the tube 62, for example by local heating of the plug 72 and/or by local heating of the projecting end of the tube 62. The plug 72 is T-shaped in the embodiment shown in FIG. 1B.

In the embodiment shown in FIG. 1C, the tube 64 forms an integral part of the ceramic wall 30. The discharge vessel 20 may, for example, be produced by an injection molding process or an extrusion process well known to those skilled in the art. The tube 64 may, for example, be directly generated during injection-molding of the discharge vessel 20. A benefit of the tube 64 forming an integral part of the ceramic wall 30 is that the production process of the discharge vessel 20 can be simplified while the tube 64 is relatively strongly bonded to the ceramic wall. Of course, the fact that the tube 64 forms an integral part of the ceramic wall 30 implies that the coefficients of expansion of the tube 64 and the ceramic wall 30 are identical, resulting in relatively low mechanical stresses in the case of a temperature gradient. The projecting end portion of the tube 64 shown in the embodiment of FIG. 1C further comprises a plug 74 for making the gastight seal 74 that closes off the discharge vessel 20. The plug 74 has a spherical shape, for example. The spherical shape may be a ball or an ellipsoid. A benefit of a substantially spherical shape is that placement tools (not shown) for placing the plug 74 on the projecting end of the tube 64 can easily pick up and position the spherically shaped plug 74, for example by means of a gripper applying vacuum to the plug 74. Because of the spherical shape, the orientation of the plug 74 on the projecting end of the tube 74 is substantially irrelevant, which simplifies the placement of the plug 74 substantially. The plug 74 is made from the same material as the ceramic wall 30 and the tube 64, which again results in relatively low mechanical stresses in the case of a temperature gradient. The plug 74, for example, is fused to the projecting end of the tube 64, for example by local heating of the plug 74 and/or by local heating of the projecting end of the tube 64.

In the embodiment of the discharge vessel 20 shown in FIG. 1C, the tube 64 is located at the ceramic wall 30 substantially in between the first and the second end portion 41, 42. At this position at the ceramic wall 30 the temperature of the ceramic wall 30 is relatively high in operation, whereby it is prevented that the temperature inside the tube 64 in operation is less than a condensation temperature of substantially any component of the ionizable filling. This is especially beneficial in a dimmable ceramic burner 14 in which the temperature distribution over the ceramic wall 30 may change during dimming. During dimming of the ceramic burner 14, the temperature of the ceramic wall 30 is typically reduced relative to the non-dimmed state. Positioning the tube 64 substantially in between the first and the second end portion 41, 42, where the temperature is typically relatively high, causes the temperature during dimming to remain above the condensation temperature of the components of the ionizable filling, resulting in a substantially color-stable ceramic burner 14.

Figure 2A:
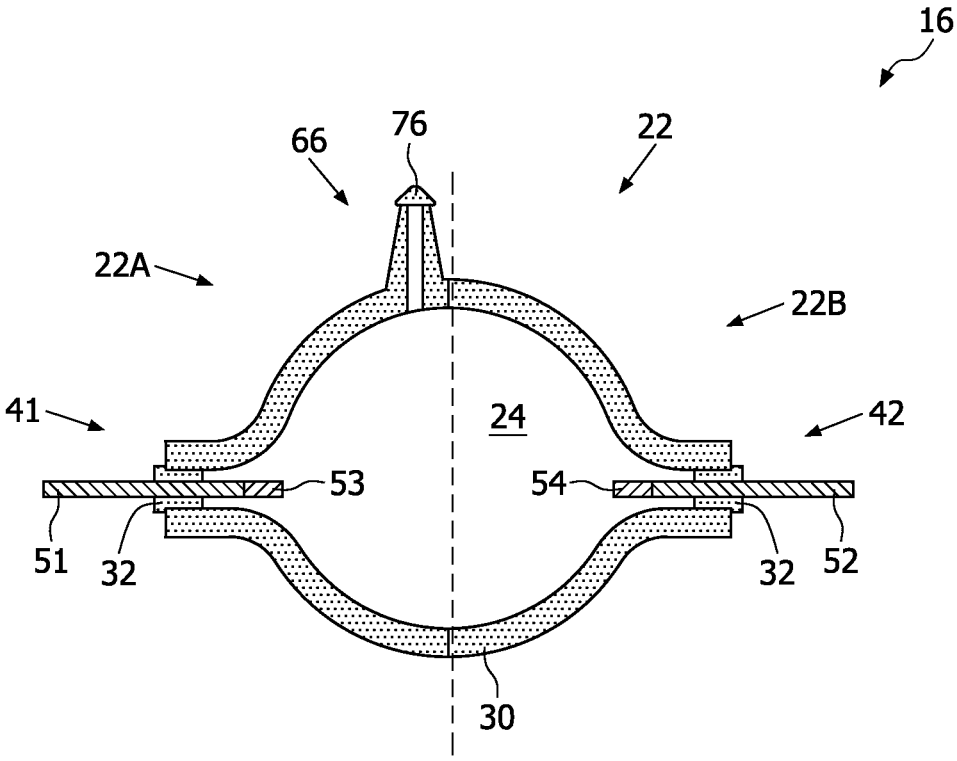
FIGS. 2A and 2B are cross-sectional views of embodiments of a ceramic burner according to the invention having a compact discharge vessel.
Figure 2B:
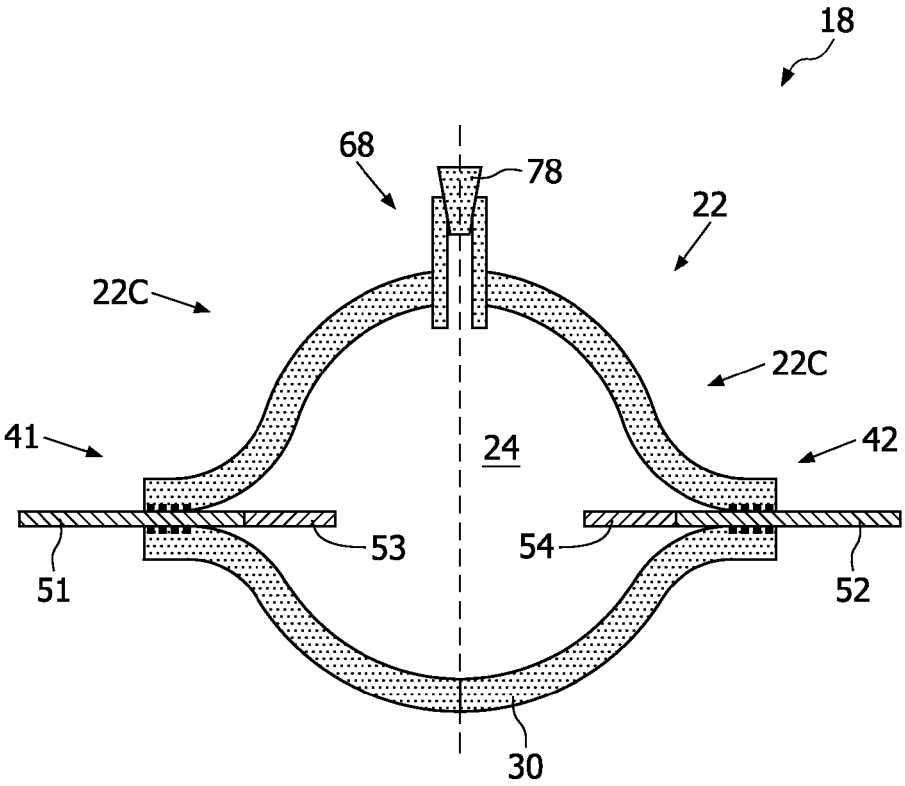

FIGS. 2A and 2B are cross-sectional views of embodiments of a ceramic burner 16, 18 according to the invention having a compact discharge vessel 22. A benefit of the use of the compact ceramic burner 16, 68 in a ceramic metal halide lamp 100 (see FIG. 3) is that the dimensions of the ceramic metal halide lamp 100 can be miniaturized. The discharge vessel 22 shown in FIGS. 2A and 2B has a further benefit in that the discharge maintained between the electrodes 53, 54 in the discharge space 24 is farther removed from the ceramic wall 30, reducing the temperature of the ceramic wall 30. Furthermore, the shape of the discharge vessel 22 results in a more homogeneous distribution of the temperature across the ceramic wall 30, resulting in fewer locations on the ceramic wall where the temperature is low enough for some components of the ionizable filing to condense and thus be removed from the discharge, which would result in a color change of the light emitted from the discharge vessel 22.

The discharge vessel 22 of the embodiments shown in FIGS. 2A and 2B may, for example, be substantially ball-shaped or substantially ellipsoidally shaped (apart from the tube).

The embodiment of the ceramic burner 16 shown in FIG. 2A comprises first and second end portions 41, 42 through each of which a respective current supply conductor 51, 52 is passed to respective electrodes 53, 54 for maintaining a discharge. The first and second end portions 41, 42 each comprise the further plug 32 which comprises the current supply conductors 51, 52, for example, directly sintered to the further plug 32 as indicated above. The discharge vessel 22 in the embodiment shown in FIG. 2A is formed by two different parts 22A, 22B (separated in FIG. 2A with a dashed line). Only a first discharge vessel part 22A comprises the tube 66 having the gastight seal 76. Each of the two different parts 22A, 22B may be produced, for example, in an injection molding process or an extrusion process, familiar to those skilled in the art. This resulting in the tube 66 forming an integral part of the first discharge vessel part 22A. Typically, the two different parts 22A, 22B are joined together and sealed, for example in a sintering process. In the embodiment shown in FIG. 2A the gastight seal 76 arranged on the projecting end of the tube 66 is made of molten material of the tube 66, for example obtained by irradiation of the projecting end of the tube 66 with a laser beam (not shown). The location of the tube 66 again is substantially in between the first and the second end portion 41, 42 to prevent that the temperature will be below the condensation temperature of any component of the ionizable filling during operation.

The embodiment of the ceramic burner 18 shown in FIG. 2B the tube 68 has a separate tube 68 arranged at the ceramic wall 30 of the discharge vessel 22. The projecting end of the tube 68 comprises a plug 78 which, for example, is directly fused to the tube 68 for creating the gastight seal 78. In the embodiment shown in FIG. 2B, the tube 68 and the plug 78 are each formed from the same material as the ceramic wall 30. The location of the tube 68 is again in between the first and second end portion 41, 42. The discharge vessel 22 is formed by two substantially identical parts 22C (separated by the dashed line in FIG. 2B), each of which may be produced, for example, in an injection molding process or an extrusion process known to those skilled in the art. The two substantially identical parts 22C are aluminum oxide parts 22C, for example, which are joined together in a gastight manner in a sintering process step so as to form the discharge vessel 22. In an embodiment of the discharge vessel 22, each of the substantially identical parts 22C may, for example, include one half of the tube 68, resulting in an embodiment in which the tube 68 forms an integral part of the discharge vessel 22 (not shown). A benefit of using two substantially identical parts 22C forming the discharge vessel 22 is that the molding or extrusion process may be done relatively simply, and only a single mold is necessary for producing the discharge vessel 22, which results in a reduction of the production cost of the ceramic burner 18. Alternatively, the substantially identical parts 22 may be injection molded or extruded without the tube 68 which may, for example, be added later in an opening at the joint between the substantially identical parts 22.

The tube 68 may, for example, be passed though the ceramic wall 30 of the discharge vessel 22 as shown in FIG. 2B. As was noted above, if passed through the ceramic wall 30, the tube 68 will not only project from the discharge vessel 20 providing a distance between the ceramic wall 30 and the gastight seal 78, but will also enter the discharge vessel 20. This provides a strong and gastight connection between the ceramic wall 30 and the tube 68.

In the embodiment of the ceramic burner 18 shown in FIG. 2B, the plug 78 and tube 68 are made of the same material as the ceramic wall 30. This results in relatively low mechanical stresses in the case of a temperature gradient. The plug 78 is conical in shape, which has the advantage that production tolerances between the dimensions of the plug 78 and the dimensions of the projecting end of the tube 68 may be relaxed. Furthermore, the gradual conical shape typically results in a seal between the conical plug 78 and the tube 68 which typically extents over a considerable length along the tube 68.

Figure 3:
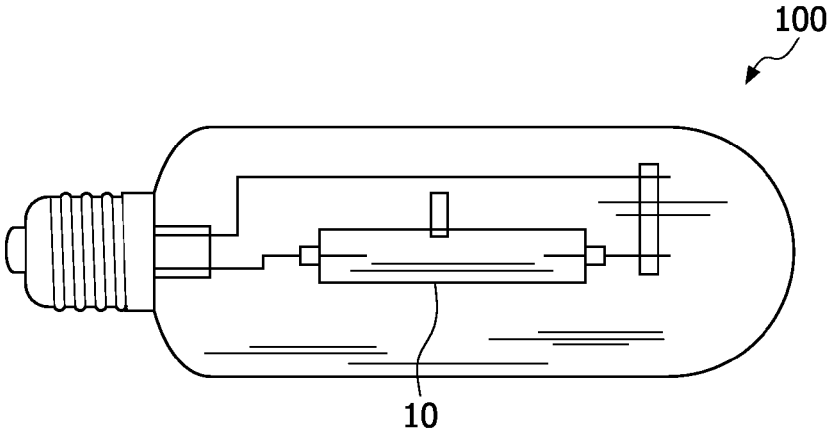
FIG. 3 shows a ceramic metal halide lamp according to the invention.

FIG. 3 shows a ceramic metal halide lamp 100 according to the invention. The ceramic metal halide lamp 100 comprises the ceramic burner 10, 12, 14, 16, 18 according to the invention.

It should be noted that the above embodiments illustrate rather than limit the invention, and that those skilled in the art will be able to design many alternative embodiments without departing from the scope of the appended claims.

In the claims, any reference signs placed between parentheses shall not be construed as limiting the claim. The use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A ceramic burner for a ceramic metal halide lamp, the ceramic burner comprising:

a discharge vessel enclosing a discharge space in a substantially gastight manner and including an ionizable filling comprising one or more halides, the discharge vessel comprising a ceramic wall arranged between a first and a second end portion, the first and the second end portion being arranged such that current supply conductors are passed through the end portions to respective electrodes arranged in the discharge space for maintaining a discharge, the ceramic wall comprising a tube for introducing the ionizable filling into the discharge vessel during manufacture of the ceramic burner, the tube projecting from the ceramic wall and comprising a gastight seal wherein the tube projects from the ceramic wall of the discharge vessel by a predefined distance (h) for limiting material stresses of the ceramic wall to below a predefined level when the gastight seal is being created, wherein the tube has an inner diameter (D1) of between 250 μm and 400 μm and wherein the tube has a wall thickness (D2) of between 150 μm and 250 μm.

2. Ceramic burner as claimed in claim 1, wherein the tube is passed through the ceramic wall.

3. Ceramic burner as claimed in claim 1, wherein the tube comprises substantially the same ceramic material as the ceramic wall.

4. Ceramic burner as claimed in claim 1, wherein the gastight seal is formed at least partially from molten material of the tube.

5. Ceramic burner as claimed in claim 4, wherein the tube has a predefined distance (h) from the ceramic wall (30) of at least 1 mm.

6. Ceramic burner as claimed in claim 1, wherein the gastight seat-comprises a plug sealed to the tube.

7. Ceramic burner as claimed in claim 6, wherein the plug has a T-shape, a spherical shape, or a conical shape.

8. Ceramic burner as claimed in claim 6, wherein the plug directly fused to the tube.

9. Ceramic burner as claimed in claim 1, wherein a location of the tube at the ceramic wall is chosen so as to prevent the temperature inside the tube from being less than a condensation temperature of substantially any component of the ionizable filling during operation.

10. Ceramic burner as claimed in claim 1, wherein the current supply conductors through each of the first and the second end portion are formed by solid rods directly sintered into the ceramic material of the first and the second end portion.

11. The ceramic burner as claimed in claim 1, wherein the predefined distance (h) of the tube varies in dependence on a ceramic material of the ceramic wall used in the discharge vessel.

* * * * *